US006789524B2

(12) United States Patent
Ino et al.

(10) Patent No.: US 6,789,524 B2
(45) Date of Patent: Sep. 14, 2004

(54) AIR INTAKE SYSTEM

(75) Inventors: Masao Ino, Toyota (JP); Toshiaki Nakayama, Nishikamo-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/769,754

(22) Filed: Feb. 3, 2004

(65) Prior Publication Data

US 2004/0154586 A1 Aug. 12, 2004

(30) Foreign Application Priority Data

Feb. 6, 2003 (JP) ..... 2003-029492

(51) Int. Cl.[7] ..... F02D 9/08
(52) U.S. Cl. ..... 123/337; 123/568.17; 251/305
(58) Field of Search ..... 123/337, 568.17, 123/184.47; 251/305

(56) References Cited

U.S. PATENT DOCUMENTS 4,327,698 A * 5/1982 Hamai et al. ..... 123/568.17
5,572,979 A * 11/1996 Czadzeck ..... 123/568.17
5,704,335 A 1/1998 Akutagawa et al. ..... 123/337
5,884,612 A * 3/1999 Takeyama et al. ..... 123/572
6,267,106 B1 * 7/2001 Feucht ..... 123/568.17
6,497,245 B1 12/2002 Torii ..... 123/337
6,609,373 B2 * 8/2003 Coleman et al. ..... 60/602
6,609,374 B2 * 8/2003 Feucht et al. ..... 60/602
6,659,427 B2 * 12/2003 Krimmer et al. ..... 251/306
2001/0040299 A1 11/2001 Schroder
2004/0040536 A1 * 3/2004 Suzuki ..... 123/337
2004/0041117 A1 * 3/2004 Suzuki ..... 251/305

FOREIGN PATENT DOCUMENTS

JP 10-103089 4/1998

* cited by examiner

*Primary Examiner*—Hai Huynh
(74) *Attorney, Agent, or Firm*—Nixon & Vanderhye P.C.

(57) ABSTRACT

An air intake system includes an intake pipe and a throttle body. The throttle body is inserted in a middle section of the intake pipe between upstream and down stream ends so as to define an intake passage. The throttle body movably receives a throttle valve which opens and closes the intake passage. Flow blocking members are integrally formed with the intake pipe for blocking specific fluid, such as condensate of intake gas, from flowing into the throttle valve in the intake passage. Therefore, it can prevent the specific fluid from sticking to the throttle valve. Besides, because the throttle body need not to be integrally formed with the flow blocking members, a dimensional accuracy of the throttle body can be secured.

9 Claims, 3 Drawing Sheets

AIR INTAKE SYSTEM

CROSS REFERENCE TO RELATED APPLICATION

This application is based on Japanese Patent Application No. 2003-29492 filed on Feb. 6, 2003, the disclosure of which is incorporated herein by reference.

BACKGROUND OF THE INVENTION

1. Field of the Invention

The present invention is related to an air intake system of an internal combustion engine.

2. Description of Related Art

In a conventional air intake system described in JP-A10-103089, a throttle body for supporting a throttle valve is inserted into an intermediate section within the intake pipe in an axial direction of the intake pipe. The throttle valve opens and closes an air intake passage which is formed by the throttle body and the intake pipe.

In the above air intake system, when moisture generated due to condensation of the intake gas sticks to the throttle valve, the throttle valve may be frozen to be immovable when the temperature is low. Therefore, a heating system or the like is provided for heating the throttle valve so that the throttle valve is prevented from being frozen.

When the heating system is provided for heating the throttle valve, significant increase of a production cost is inevitable. Therefore, an air intake system may be considered such that a flow blocking member is integrally provided with a throttle body in a bore, so that moisture is blocked from flowing to the throttle valve. However, in this case, an extra member such as the flow blocking member is provided in the throttle body. Thus, the throttle body deforms when the flow blocking member is integrally formed with the throttle body, and dimensional accuracy of the bore is apt to decrease. When the dimensional accuracy of the bore decreases, tolerance of a clearance formed between the inner wall surface of the bore, which defines an air intake passage, and the outer peripheral section of the throttle valve increases.

SUMMARY OF THE INVENTION

In view of the foregoing problems, it is an object of the present invention to provide an air intake system, in which a specific fluid is restricted from reaching the throttle valve while a dimensional accuracy of the throttle valve is secured. The other object of the present invention is to provide an air intake system which can decrease a production cost.

According to the present invention, an air intake system includes an intake pipe, a throttle body, a throttle valve and a flow blocking member. The intake pipe has an upstream end and a downstream end. The throttle body is inserted into the intake pipe at a section between the upstream end and the downstream end in an axial direction of the intake pipe, so as to define an intake passage with the intake pipe through which intake gas flows. The throttle valve opens and closes the intake passage, and is supported in the throttle body. In the air intake system, the flow blocking member is integrally formed with the intake pipe for blocking a flow of a specific fluid toward the throttle valve in the intake passage. Accordingly, an extra member, such as the flow blocking member, need not to be provided to the throttle body. Thus, a forming deformation of the throttle body is prevented and a dimensional accuracy of the throttle body can be secured.

Furthermore, because the flow blocking member is integrally formed with the intake pipe, an increase of a production cost due to adding the flow blocking member can be prevented.

Preferably, the flow blocking member is arranged at an upstream side with respect to the throttle valve in the intake passage, and the specific fluid is a condensate of the intake gas passing through the intake passage. In this case, the condensate can be effectively collected around the flow blocking member, and it can effectively prevent the condensate from being introduced into the throttle valve by the flow blocking member.

Specifically, the flow blocking member forms an inlet port which opens to an upstream side in the intake passage, and the inlet port is provided in such a manner that the condensate is introduced into the inlet port from an upstream side with respect to the throttle valve in the intake passage. Further, the flow blocking member includes an inner-pipe section that is arranged in an inner peripheral side of the intake pipe substantially in parallel in axial so as to form the inlet port between the intake pipe and the inner-pipe section, and a blocking section that closes between the intake pipe and the inner-pipe section on a downstream side with respect to the inlet port of the intake passage.

Preferably, the flow blocking member is arranged at a downstream side with respect to the throttle valve in the intake passage, and the specific fluid is exhaust gas exhausted from an internal combustion engine and introduced into the intake passage. In this case, a flow of exhaust gas toward the throttle valve is blocked by the flow blocking member. In this case, the intake pipe has an introduction port for introducing the exhaust gas to a downstream side with respect to the throttle valve in the intake passage. The flow blocking member forms an outlet port, which opens to a downstream side in the intake passage, on a downstream side with respect to the introduction port of the intake passage. Further, the flow blocking member is provided to guide the exhaust gas, which is introduced into the introduction port, to a downstream side through the outlet port. Specifically, the flow blocking member includes an inner-pipe section that is arranged in an inner peripheral side of the intake pipe substantially in parallel in axial so as to form the outlet port between the intake pipe and the inner-pipe section, and a blocking section that closes between the intake pipe and the inner-pipe section on an upstream side with respect to the introduction port of the intake passage.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1:
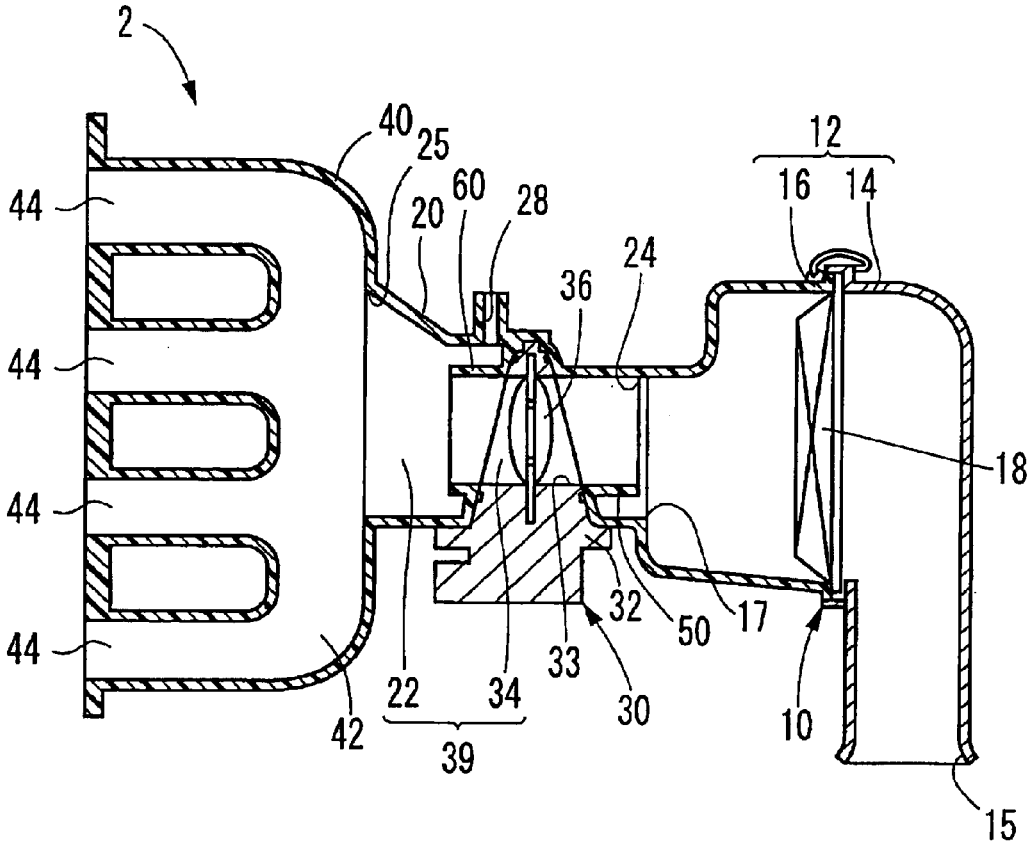
FIG. 1 is a cross-sectional view showing an air intake system according to an embodiment of the present invention.
Figure 2:
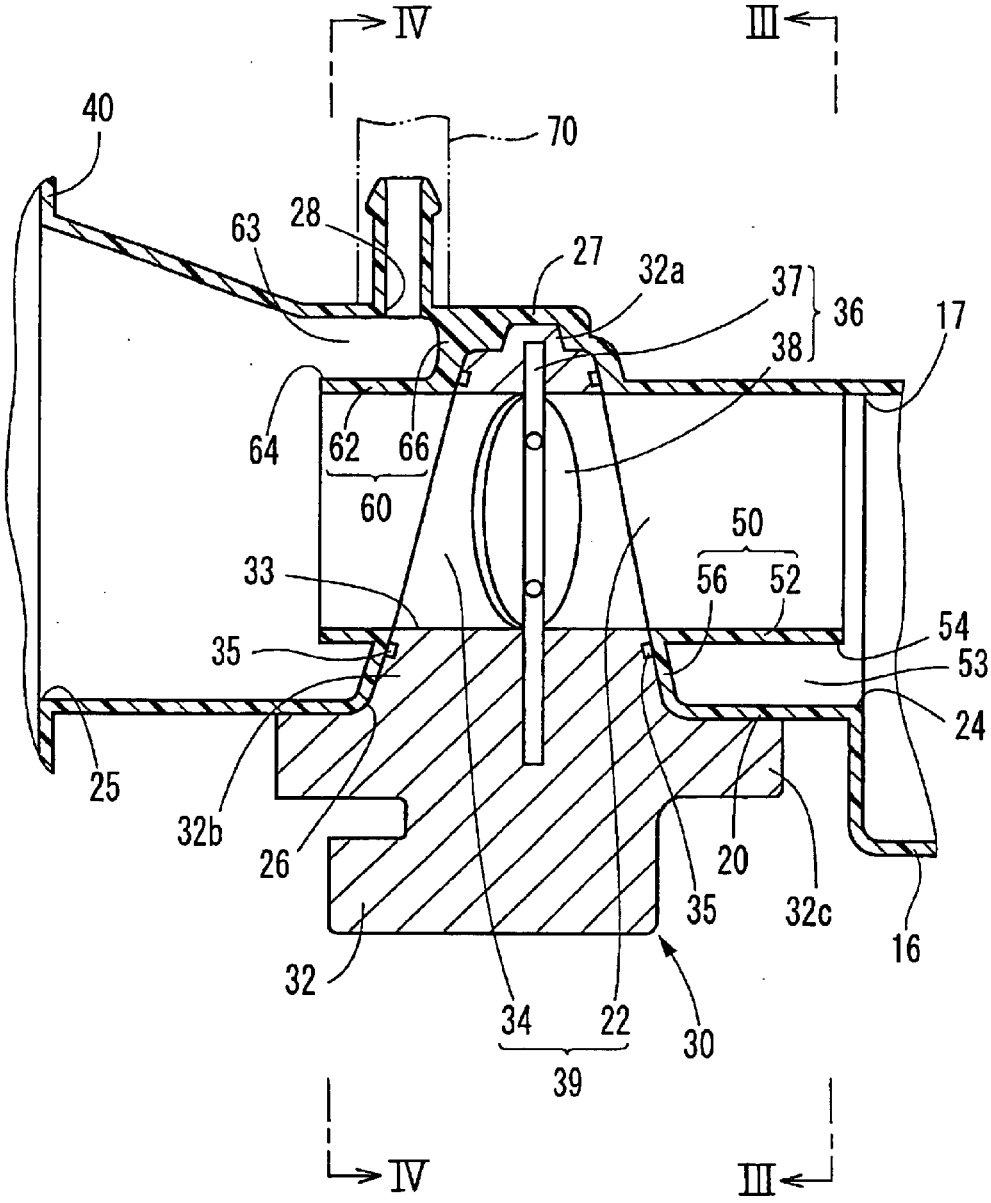
FIG. 2 is an enlarged cross-sectional view showing a main part in FIG. 1.

As shown in FIGS. 1 and 2, an air intake system 2 has an air-cleaner section 10, an intake pipe 20, a throttle section 30, an intake manifold 40, and first and second flow blocking members 50, 60.

The air-cleaner section 10 has a cleaner case 12 and a cleaner filter 18. A dusty-side case 14 and a clean-side case 16 are respectively formed in cup shapes, and are connected to each other so that the cleaner case 12 is constructed.

The dusty-side case 14 has a cleaner-inlet port 15 which introduces intake gas into an inner section of the air cleaner section 10. The clean-side case 16 has a cleaner-outlet port 17 through which the cleaned intake gas is introduced to the outer section of the air cleaner section 10. The cleaner case 12 receives the cleaner filter 18 in a connection boundary between the dusty-side case 14 and the clean-side case 16. The cleaner filter 18 is made of a nonwoven fabric or a filter paper, for example, so as to filter intake gas passing through the cleaner filter 18.

The intake pipe 20 is formed in a substantially cylindrical shape. The inner wall surface of the intake pipe 20 defines an inner-piping passage 22. An intake-air inlet port 24 of the intake pipe 20 forms an upstream-side end section of the inner-piping passage 22. The intake-air inlet port 24 is connected with the cleaner-outlet port 17 of the clean-side case 16. An intake-air outlet port 25 of the intake pipe 20 forms a downstream-side end section of the inner-piping passage 22. The intake-air outlet port 25 is connected with a surge tank 42 of the intake manifold 40. Intake gas flowing into the intake-air inlet port 24 is introduced to the intake-air outlet port 25 through the inner-piping passage 22.

As shown in FIG. 2, the intake pipe 20 has an insertion port 26 and a holding section 27. The insertion port 26 penetrates an axially middle section of the intake pipe 20 in the diametrical direction of the intake pipe 20. In detail, the insertion port 26 penetrates a middle section of the intake pipe 20, between the intake-air inlet port 24 and the intake-air outlet port 25 in the axial direction of the intake pipe 20. The holding section 27 is arranged at a section which opposes to the insertion port 26 in the diametrical direction of the intake pipe 20. The holding section 27 is formed in a hole-shape which opens to an inner peripheral surface of the intake pipe 20. A throttle body 32 of the throttle section 30 is inserted to fit to the holding section 27 and the insertion port 26.

The intake pipe 20 further includes an introduction port 28. The introduction port 28 is arranged at a section which is located on a downstream side with respect to the holding section 27 of the inner-piping passage 22. The introduction port 28 is connected with a communication pipe 70 which is connected to an exhaust pipe of the engine and a crank case of the engine. Exhaust gas, such as blow-by gas, EGR gas, and a mixture gas of the blow-by gas and EGR gas, discharged from the engine are introduced to the introduction port 28. The throttle section 30 has a throttle body 32, a sealing member 35 and a throttle valve 36. The throttle body 32 is formed in a thick-plate shape. A one-end section 32*a* of the throttle body 32 is fitted into the holding section 27. A middle section 32*b* of the throttle body 32 is fitted into the insertion port 26. The throttle body 32 is secured to the intake pipe 20 using a screw on the side of an other-end section 32*c*. The bore 33 is formed to penetrate through the throttle body 32 in the thickness-direction of the throttle body 32. Specifically, the bore 33 is formed in the thickness-direction of the thick-plate shaped throttle body 32 to penetrate through the throttle body 32. The inner-wall surface of the throttle body 32, defining the bore 33, forms a body-internal passage 34. The body-internal passage 34 is inserted in a middle section of the inner-piping passage 22 formed in the intake pipe 20. Through the body-internal passage 34, intake gas flowing from the inner-piping passage 22 located on the upstream side with respect to the gas flow direction is introduced to the inner-piping passage 22 located on the downstream side. Therefore, a continuous intake passage is formed by the body-internal passage 34 and the inner-piping passage 22. That is, the continuous intake passage is constructed with the body-internal passage 34, the inner-piping passage 22 located on the upstream side and the inner-piping passage 22 located on the downstream side. The connecting sections between the throttle body 32 and the intake pipe 20 are sealed by two sealing members 35. The two sealing members 35 surrounds an inlet port of the body-internal passage 34 and an outlet port of the body-internal passage 34.

The throttle valve 36 is arranged in a middle section of the body-internal passage 34, which is positioned at an upstream side with respect to the introduction port 28 of the intake passage 39. The throttle shaft 37 of the throttle valve 36 extends in the direction where the insertion port 26 opposes to the holding section 27, so as to across the body-internal passage 34. Both of the end sections of the throttle shaft 37 are rotatably supported by the throttle body 32. The valve body 36 of the throttle valve 36 is formed in a disc-shape, and is received in the body-internal passage 34. The throttle shaft 37 is rotated by a driving unit (not shown), so that the valve body 38 opens and closes the body-internal passage 34. A flow rate of intake gas in the body-internal passage 34 (i.e., flow rate of intake gas in the entire intake passage 39) is controlled in accordance with a clearance defined between the outer peripheral section of the valve body 38 and the inner peripheral surface of the bore 33 (throttle body).

Referring back to FIG. 1, the intake manifold 40 has the surge tank 42 and the multiple distribution pipes 44. The multiple distribution pipes 44 branch from a portion of the surge tank 42 which is located on the opposite side with respect to the intake pipe 20. Each distribution pipe 44 is respectively connected with corresponding engine cylinder on the opposite side with respect to the surge tank 42. Intake gas and exhaust gas flow into the surge tank 42. The intake manifold 40 substantially evenly distributes the intake gas and the exhaust gas to each engine cylinder through each distribution pipe 44 respectively.

The first and second flow blocking members 50, 60, the intake pipe 20, the clean side case 16 and the intake manifold are integrally formed of resin, so that production costs are reduced.

Figure 3:
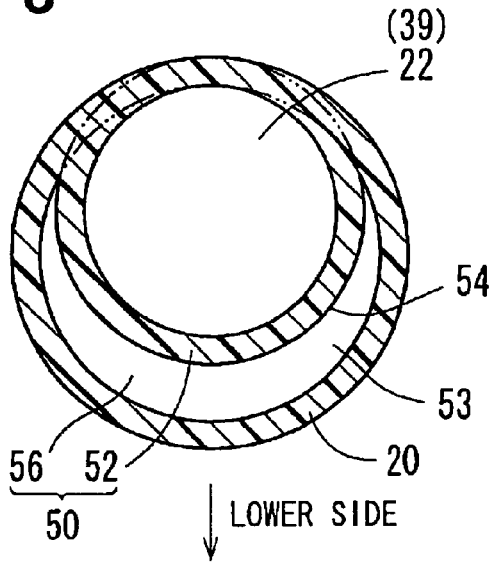
FIG. 3 is an enlarged cross-sectional view taken along the line III—III in FIG. 2.

As shown in FIGS. 1 to 3, the first flow blocking member 50 is arranged in the inner-piping passage 22 located on the upstream side with respect to the body-internal passage 34. That is, the first flow blocking member 50 is arranged on the upstream side with respect to the throttle valve 36 provided in the intake passage 39. The first flow blocking member 50 has an inner-pipe section 52 and a blocking section 56. The inner-pipe section 52 is arranged on the inner peripheral side of the intake pipe 20 substantially in parallel with each other in axial. That is, the axis of the inner-pipe section 52 and the axis of the intake pipe 20 are substantially parallel to each other. The inner-pipe section 52 and the intake pipe 20 are eccentrically arranged each other so as to construct a double-pipe structure. That is, the peripheral wall of the inner-pipe section 52 and the peripheral wall of the intake pipe 20 construct eccentrically dual-layered cylindrical structure. Thus, a space 53 is defined between the inner-pipe section 52 and the intake pipe 20. The space 53 extends in the peripheral direction of the intake pipe 20, so as to form a C-shape in the cross-section of the intake pipe 20. The width of the C-shaped space 53 becomes maximum in the vicinity of the insertion port 26 with respect to the diametrical direction of the intake pipe 20. The air-intake system 2 is mounted in the engine. The maximum portion of the space 53, where the diametrical width of the space 53 is maximum, is located on the lower side, as shown in FIGS. 2 and 3. The end section of the inner-pipe section 52, which is located on the side of the intake-air inlet port 24, forms an inlet port 54 between the intake pipe 20 and the end section of the inner-pipe section 52. The inlet port 54 is opened to the upstream side with respect to intake gas flow in the inner-piping passage 22. The blocking section 56 is provided to close between the intake pipe 20 and the end of the inner-pipe section 52, which is located on the side of the body-internal passage 34 at a downstream side of intake gas flow with respect to the inlet port 54 of the inner piping passage 22.

Figure 4:
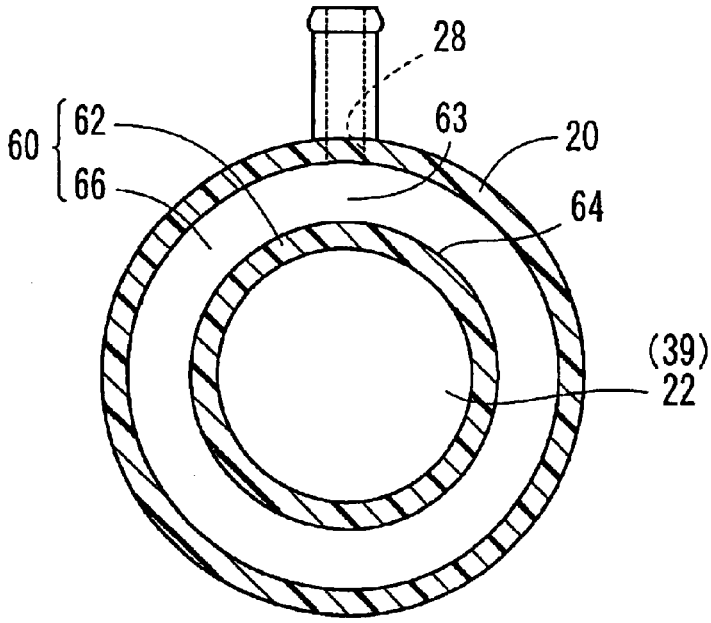
FIG. 4 is an enlarged cross-sectional view taken along the line IV—IV in FIG. 2.

As shown in FIGS. 1, 2 and 4, the second flow blocking member 60 is arranged in an inner-piping passage 22 located on the downstream side of intake gas flow with respect to the body-internal passage 34. That is, the second flow blocking member 60 is arranged on a downstream side of intake gas flow with respect to the throttle valve 36 in the intake passage 39. The second flow blocking member 60 has an inner-pipe section 62 and a blocking section 66. The inner-pipe section 62 is arranged on an inner peripheral side of the intake pipe 20 substantially in parallel with each other in axial. That is, the axis of the inner-pipe section 62 and the axis of the intake pipe 20 are substantially parallel to each other. The inner-pipe section 62 and the intake pipe 20 are concentrically arranged each other so as to construct a double-pipe structure shown in FIG. 4. That is, the peripheral wall of the inner-pipe section 62 and the peripheral wall of the intake pipe 20 construct concentrically dual-layered cylindrical structure. Thus, a space 63 is defined between the inner-pipe section 62 and the intake pipe 20. The space 63 circumferentially extends in the peripheral direction of the intake pipe 20 from the vicinity of the introduction port 28. The end section of the inner-pipe section 62, which is located on the side of the intake-air outlet port 25, forms an outlet port 64 between the intake pipe 20 and the end section of the inner-pipe section 62. The outlet port 64 is arranged on a downstream side of intake gas flow with respect to the introduction port 28 of the inner-piping passage 22. The outlet port 64 is opened to the downstream side with respect to intake gas flow in the inner-piping passage 22. The blocking section 66 is provided to close between the intake pipe 20 and the end of the inner-pipe section 62, which is located on the side of the holding section 27, at an upstream side of intake gas flow with respect to the introduction port 28 of the inner piping passage 22.

Intake gas flows into an inner section of the dusty-side case 14 from the cleaner-inlet port 15 by an intake operation of the engine. The intake gas passes the cleaner filter 18, and is filtered. Subsequently, the intake gas is introduced from an inner section of the clean side case 16 to the intake-air inlet port 24 of the intake pipe 20 through the cleaner-outlet port 17. The intake gas is introduced to the intake-air inlet port 24, and passes through the intake passage 39 while a flow rate of the intake gas is controlled by the throttle valve 36. The intake gas is introduced to the surge tank 42, and distributed to each cylinder of the engine through each distribution pipe 44.

In general, intake gas is taken from exterior air. When the intake gas condenses in the vicinity of the cleaner case 12 and the intake-air inlet port 24 of the intake pipe 20, liquid (condensate), such as moisture, is generated. The condensate of the intake gas flows into the cleaner case 12 and the inner-piping passage 22 of the intake pipe 20 along with intake gas flow. Subsequently, the condensate of the intake gas flows into the space 53 of the first flow blocking member 50 from the inlet port 54 before the condensate reaches the throttle valve 36. The condensate flowing into the space 53 sticks to the first flow blocking member 50 so as to be collected and removed. Thus, the condensate flowing to the throttle valve 36 is blocked by the first flow blocking member 50, so that it can restrict the condensate from reaching the throttle valve 36. Therefore, it can prevent the condensate from sticking to the throttle valve 36, thereby preventing the throttle valve 36 from being frozen when temperature is low. Especially in the air-intake system 2, the first flow blocking member 50 can be arranged on the upstream side with respect to the throttle valve 36 of the intake passage 39, so as to evade a turbulent flow area in the vicinity of the throttle valve 36. Therefore, a flowing direction of the condensate is stabilized around the first flow blocking member 50, so that a desirable collecting and removing effect of the condensate can be certainly achieved.

Exhaust gas is introduced from the engine into the introduction port 28 and flows into the space 63 of the second flow blocking member 60 by the intake operation of the engine. Subsequently, the exhaust gas is introduced to the outlet port 64 along the inner-pipe section 62. At the moment, impurity included in the exhaust gas, such as grease spot, is introduced to the outlet port 64 while sticking to the second flow blocking member 60. The exhaust gas and the impurity reach the outlet port 64, and are introduced out of the space 63 of the inner-piping passage 22 through the outlet port 64. The exhaust gas and the impurity collide against intake gas flowing in the inner-piping passage 22, and are restrained from flowing to the throttle valve 36, so that the exhaust gas and the impurity flows to the surge tank 42 in the inner-piping passage 22. Thus, the exhaust gas and the impurity are restrained from flowing to the throttle valve 36 by a guiding function of the second flow blocking member 60 and the collision against intake gas flowing in the inner-piping passage 22. Thus, it can be prevented the exhaust gas and the impurity from reaching the throttle valve 36. Therefore, pollution of the throttle valve 36, which is caused by sticking of impurity contained in exhaust gas, can be evaded. Especially in the air-intake system 2, the outlet port 64 can be arranged to be apart from the throttle valve 36 on the downstream side of the intake passage 39. Therefore, an amount of exhaust gas and impurity, which reaches the throttle valve 36, can be effectively decreased. Exhaust gas flows out of the outlet port 64, and reaches the surge tank 42, so that the exhaust gas is distributed to each cylinder of the engine from each distribution pipe 44.

In the air-intake system 2 described above, the flow blocking members 50, 60, which block a flow of a specific fluid, are integrally formed with the intake pipe 20, but is not integrally formed with the throttle body 32. Therefore, an extra members, such as the flow blocking members 50, 60, need not to be provided to the throttle body 32. Therefore, deformation of the throttle body 32 is prevented and a dimensional accuracy of the bore 33 is secured. Thus, tolerance can be reduced in a clearance between the outer peripheral section of the valve body 38 and the inner peripheral surface of the throttle body 32, defining the bore 33.

Furthermore, the clean-side case 16 and the intake manifold 40 are integrally formed with the intake pipe 20 in addition to the flow blocking members 50, 60, in the air-intake system 2. Therefore, the intake pipe 20 can be extended so that the clean-side case 16 and the throttle-body 32, and the intake manifold 40 and the throttle body 32 are respectively connected. Thus, a degree of freedom of positions where the flow blocking members 50, 60 are formed, and a degree of freedom in an adjustment of the length of the inner-pipe sections 52, 62 increase in the longitudinal direction (axial direction) of the intake pipe.

Although the present invention has been fully described in connection with the preferred embodiment thereof with reference to the accompanying drawings, it is to be noted that various changes and modifications will become apparent to those skilled in the art.

For example, in the above embodiment, the single first flow blocking member 50 and the single second flow blocking member 60 are respectively provided. The first flow blocking member 50 blocks the flow of condensate generated by condensation of intake gas. The second flow blocking member 60 blocks the flow of exhaust gas exhausted from the engine. On the contrary, an appropriate number of either the flow blocking member, which blocks the flow of the condensate, or the flow blocking member, which blocks flow of the exhaust gas, can be provided. Besides, a number of both kind of the flow blocking members can be provided. In the above embodiment, the flow blocking members 50, 60 are formed with the intake pipe 20 so as to construct a shape which forms the double-pipe structure, so that the structure is simplified. However, various shapes, which can block the specific fluid flow, can be adopted as the shape of the flow blocking member. For example, multiple inner-pipe sections are provided on the inner peripheral side of the intake pipe, so that the inner-pipe sections and the intake pipe construct a multiple-pipe structure (multiple-layered cylindrical structure). In this case, a blocking section closes a space between the inner-pipe section and the intake pipe.

In the above embodiment, both the clean-side case 16, which is a part of the cleaner case 12, and the intake manifold 40 are integrally formed with the intake pipe 20 and the flow blocking members 50, 60. On the contrary, either the clean-side case 16 or the intake-manifold 40 can be integrally formed with the components 20, 50 and 60. The intake-manifold 40 can be partially integrally formed with the components 20, 50 and 60.

Such changes and modifications are to be understood as being within the scope of the present invention as defined by the appended claims.

What is claimed is:

1. An air intake system comprising:

an intake pipe having an upstream end and a downstream end;

a throttle body that is inserted into the intake pipe at a section between the upstream end and the downstream end in an axial direction of the intake pipe so as to define an intake passage with the intake pipe, through which intake gas flows;

a throttle valve which opens and closes the intake passage, the throttle valve being supported in the throttle body; and a flow blocking member, which is integrally formed with the intake pipe, for blocking a flow of a specific fluid toward the throttle valve in the intake passage.

2. The air intake system according to claim 1, wherein:

the flow blocking member is arranged at an upstream side with respect to the throttle valve in the intake passage; and the specific fluid is a condensate of the intake gas passing through the intake passage.

3. The air intake system according to claim 2, wherein:

the flow blocking member forms an inlet port which opens to an upstream side in the intake passage; and the inlet port is provided in such a manner that the condensate is introduced into the inlet port from an upstream side with respect to the throttle valve in the intake passage.

4. The air intake system according to claim 3, wherein:

the flow blocking member includes an inner-pipe section that is arranged in an inner peripheral side of the intake pipe substantially in parallel in axial so as to form the inlet port between the intake pipe and the inner-pipe section, and a blocking section that closes between the intake pipe and the inner-pipe section on a downstream side with respect to the inlet port of the flow blocking member.

5. The air intake system according to claim 1, wherein:

the flow blocking member is arranged at a downstream side with respect to the throttle valve in the intake passage; and the specific fluid is exhaust gas exhausted from an internal combustion engine and introduced into the intake passage.

6. The air intake system according to claim 5, wherein:

the intake pipe has an introduction port for introducing the exhaust gas to a downstream side with respect to the throttle valve in the intake passage;

the flow blocking member forms an outlet port, which opens to a downstream side in the intake passage, on a downstream side with respect to the introduction port of the intake passage; and the flow blocking member is provided to guide the exhaust gas, which is introduced into the introduction port, to a downstream side through the outlet port.

7. The air intake system according to claim 6, wherein:

the flow blocking member includes an inner-pipe section that is arranged in an inner peripheral side of the intake pipe substantially in parallel in axial so as to form the outlet port between the intake pipe and the inner-pipe section, and a blocking section that closes between the intake pipe and the inner-pipe section on an upstream side with respect to the introduction port of the intake passage.

8. The air intake system according to claim 1, further comprising:

a cleaner filter which filters intake gas; and a cleaner case, that receives the cleaner filter, through which intake gas after passing through the cleaner filter is introduced into an upstream end section of the air-intake passage, wherein at least a portion of the cleaner case is integrally formed with the intake pipe and the flow blocking member.

9. The air intake system according to claim 1, further comprising an intake manifold that distributes intake gas from a downstream end section of the intake passage to cylinders of an internal cobustion engine, wherein at least a portion of the intake manifold is integrally formed with the intake pipe and the flow blocking member.

* * * * *